United States Patent [19]

Lockard

[11] Patent Number: 4,466,050

[45] Date of Patent: Aug. 14, 1984

[54] LIGHT DISPLAY ASSEMBLY

[75] Inventor: Joseph L. Lockard, Harrisburg, Pa.

[73] Assignee: AMP Incorporated, Harrisburg, Pa.

[21] Appl. No.: 513,131

[22] Filed: Jul. 14, 1983

Related U.S. Application Data

[63] Continuation of Ser. No. 238,784, Feb. 27, 1981, abandoned.

[51] Int. Cl.[3] ..... F21V 7/00

[52] U.S. Cl. ..... 362/307; 362/249; 362/294; 362/310; 362/347; 362/375; 362/800; 362/812

[58] Field of Search ..... 362/307, 310, 347, 375, 362/800, 812, 249, 294

[56] References Cited

U.S. PATENT DOCUMENTS 4,257,084 3/1981 Reynolds ..... 362/800

4,298,869 11/1981 Okuno ..... 362/800

*Primary Examiner*—Stephen J. Lechert, Jr.

*Attorney, Agent, or Firm*—Richard G. O'Planick; Adrian J. LaRue; Anton P. Ness

[57] ABSTRACT

A back light display assembly is disclosed comprising a dielectric body having a cavity extending therethrough profiled for accepting a pair of contact components. The contact components each comprise a planar body having an upwardly-directed resilient finger at one end, and an insulation displacement structure at the opposite end which projects through the dielectric housing cavity to a bottom surface thereof. The pair of resilient contact component fingers are positioned so as to receive a light-emitting diode semiconductor chip therebetween, and a pair of conductors are engageably mated to respective insulation displacement structure of the contact components to effectuate an electrical path to the semiconductor chips. The dielectric body is packaged within a receptacle having an interior chamber which receives the dielectric body therein. The receptacle-dielectric body subassembly is further packaged within an outer encasement, resulting in an integral light display package suitable for use in instrument panels or the like, as for message display.

13 Claims, 7 Drawing Figures

LIGHT DISPLAY ASSEMBLY

This is a continuation of application Ser. No. 238,784, filed Feb. 27, 1981, now abandoned.

BACKGROUND OF THE INVENTION

1. The Field of the Invention

The present invention relates to a light display assembly suitable for incorporation into an instrumental panel or the like, as a back light for message display. Specifically, the present invention relates to light display assemblies which are amenable to automated assembly.

2. The Prior Art

Light display assemblies are being utilized increasingly in a variety of applications, such as in automobile display panels, instrumentation panels, industrial equipment, etc. Conventionally, the display assemblies comprise incandescent lamps which are electrically terminated by a wire which is inserted into a socket or soldered to a board. The package is further packaged into an encasement of some sort or another, which presents a transparent surface through which emitted light can escape. While such assemblies work well, certain shortcomings exist which prevent the light display assemblies currently available from solving all of the industry's needs. For example, the life of an incandescent lamp can be relatively short, necessitating frequent replacement of burnt-out lamps. Also, incandescent lamps have relatively large power requirements. Still further, it may be difficult to replace an incandescent lamp in presently available light display assemblies, and such assemblies are difficult, if not impossible, to repair in the field.

SUMMARY OF THE PRESENT INVENTION

The present invention teaches a back light display assembly comprising a pair of contact components, which resiliently sandwich a semiconductor chip between resilient finger portions thereof. Each contact component further provides a depending portion at an opposite end, which effectuates insulation displacement engagement with an electrical conductor. Insulation displacement engagement represents an ideal way for effectuating electrical interconnection of the light-emitting diode, and the large integral contact components provide additional advantage as a heat-sinking mass. The contact components are seated within a dielectric body cavity, and the insulation displacement portions of each component project through the dielectric body and into wire-receiving channels which are provided in the bottom surface of the dielectric body, and which provide integral strain relief means. A pair of conductors, and a current-limiting resistor are seated within the channels of the dielectric body, and an electrical circuit is thereby established to couple the pair of LED's in series. The dielectric body is inserted into the chamber of a reflective body, which chamber being defined by concave sidewalls. The reflective body is assembled into a receptacle lens block which provides a lensing surface facing the LED chips. Finally, an outer encasement body is provided which receives the receptacle block therein, and which serves to protect the overall assembly as well as providing the modular means for mounting the light display assembly into an instrument panel or the like.

Accordingly, it is an object of the present invention to provide a back light display assembly featured having semiconductor light sources.

A further object to the present invention is to provide a light display assembly having contacts which are manufacturable in continuous strip format, and which provide an integral heat-sinking mass.

Yet a further object of the present invention is to provide a light display assembly featuring means for serially interconnecting multiple LED's.

Still further, it is an object of the present invention to provide a light display assembly embodied as an integral package, including at least one LED, a lens, and electrical interconnection means for activating the LED.

Another object of the present invention is to provide a light display assembly featuring lens and housing structure for facilitating the delivery of a maximum degree of back light illumination.

Still another object of the present invention is to provide a light display assembly which structurally accomodates a pre-assembly of the contact and the LED components, in order to enable pre-testing of the contact and electrical system prior to final assembly of the package.

A further object of the present invention is to provide a light display assembly comprising relatively few parts, and featured having contacts structured for providing an integral heat-sinking mass for dissipating heat generated by the LED active devices.

A further object of the present invention is to provide a light display package which is economically and readily produced, and readily assembled.

These and other objects, which will become apparent to one skilled in the art, are achieved by a preferred embodiment which is described in detail below and which is illustrated in the accompanying drawings.

BRIEF DESCRIPTION OF THE ACCOMPANYING DRAWINGS

DETAILED DESCRIPTION OF THE PREFERRED EMBODIMENT

Figure 1:
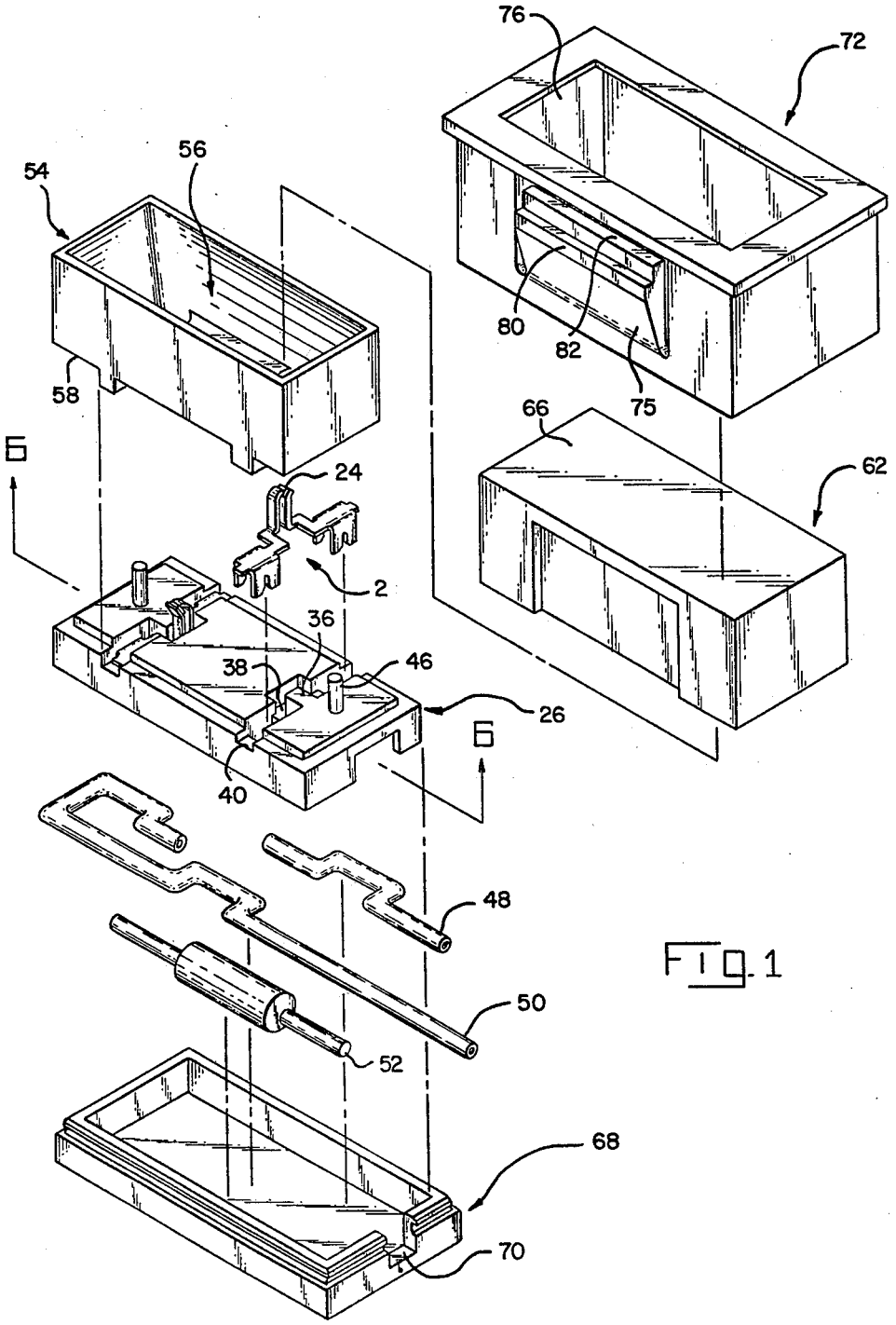
FIG. 1 is an exploded perspective view of the subject light display assembly, illustrating the component parts.
Figure 2:
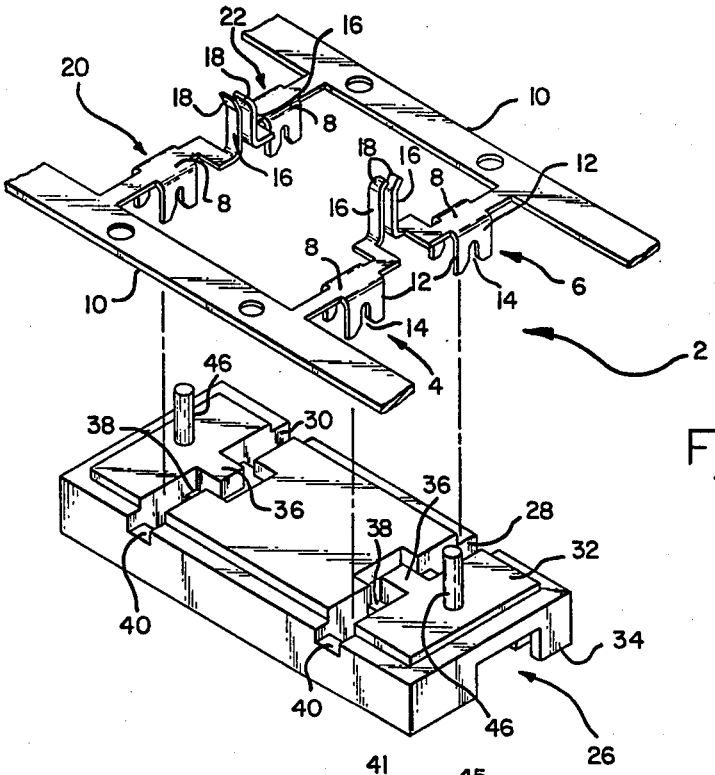
FIG. 2 is an exploded perspective view of the contact and dielectric housing subassembly of the subject invention, illustrating the contacts in strip form pursuant to the manufacturing and forming operations, and the dielectric housing which receives the contact components prior to their severence from the carrier strip.

The subject invention, as illustrated in FIG. 1, comprises a contact unit 2 composed of contact components 4,6. As best seen from FIG. 2, each of the components 4,6, comprises a stamped right-angle shaped planar body portion 8 which is integrally joined at one end to a carrier strip 10. A pair of parallel and spaced-apart dependent beams 12 extend downwardly from a side of the body portion 8, proximate to the carrier strip 10. Each dependent beam 12 further is structured to provide an insulation displacement slot 14 of decreasing width which projects upwardly therein. A resilient spring finger 16 is formed to project vertically from an opposite end of the body portion 8, and includes a biased tip portion 18 at a remote end thereof. It will be appreciated that the bias of the tip portion 18 of contact component 4 is parallel to the bias of the contact component tip portion 18 of corresponding contact 6 so that the tip portions 18 of components 4 and 6 are normally in contact for a purpose to be explained below. As shown in FIG. 2, adjacent contact components 20,22 are serially spaced along and integrally joined to the carrier strips 10. Components 20,22 are formed substantially identical to the contact components 4,6. It should be noted that the biased tip portions 18 of the opposed contact components 20,22 are biased in a direction opposite to the bias of the tip portions 18 of contact components 4,6. This configuration is necessary for serial interconnection of the contacts as will be explained in greater detail below. Moreover, the strips 10 are identically structured, having serial contact components integrally formed therealong, with alternative contact components having tip portions biased in opposite directions so that when two identical strips 10 are opposed to one another, the contact components along each strip will correspond appropriately with the corresponding components of the opposite strip. Each of the tip portions is coated with conductive solder as explained below.

As indicated in FIG. 1, a light-emitting diode 24, constitutes a further component of the subject light display assembly, and is intended for positionment between biased tip portions 18 of the contact components 4,6, and 20,22. Each semiconductor chip 24 is resiliently retained between the biased tip portions by operation of the resilient spring finger 16, which serves to exert residual spring forces against the semiconductor chip. Continuing, with particular reference to FIG. 2, the subject invention further constitutes a dielectric housing component 26 having a pair of serpentine-shaped cavities 28,30, extending from an upper surface 32 to a bottom surface 34 thereof. Each of the cavities 28,30, are bisected by an internal projection 36, which is flanked by a pair of internal support surfaces 38. A pair of outer support surfaces 40 are further positioned within each of the cavities 28,30, and are located proximate the sides of the dielectric housing 26.

Figure 3:
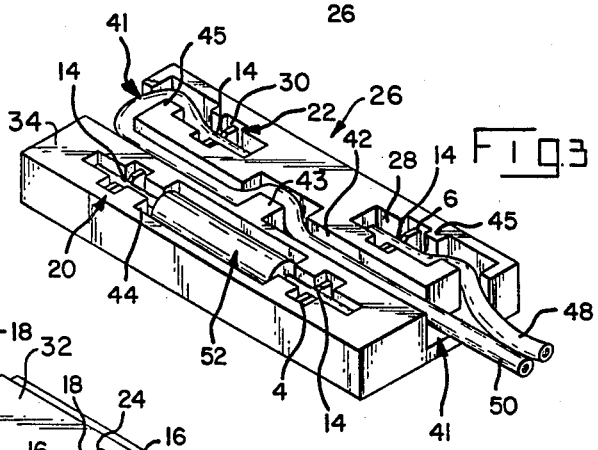
FIG. 3 is a perspective view of the underside of the dielectric housing shown in FIG. 2, and illustrates positionment of the electrical conductors in appropriate channels of the housing and in electrical engagement with the contacts and strain relief seated therein.

Proceeding, with reference to FIG. 3, the dielectric housing 26 is provided with a longitudinally-extending channel 42 in the bottom surface 34 thereof. The longitudinal channel 42 communicates with one end of both of the cavities 28,30, and is dimensioned to receive a single electrical conductor therein which can exit from either end opening 41. The channel 42 is penetrated by strain relief protrusions 45 at either end, and a strain relief protrusion 43 intermediate thereof. A second, longitudinal channel 44 extends along one side of the bottom surface 34 of the dielectric housing 26, and communicates with an opposite end of both the cavities 28,30. Returning to FIG. 1, a pair of alignment posts 46 project vertically from the upper surface of the dielectric housing 26 for a purpose explained in greater detail below.

A pair of insulated electrical conductors 48,50, further comprise component parts of the subject light display assembly. A current-limiting resistor 52 is likewise provided for the purpose of controlling driving current to the serially-connected LED's. Proceeding, a reflective block 54 of general block-like configuration is provided, which is composed of reflective material, and having a concave profiled cavity 56 which extends into the reflective block 54 toward a bottom surface 58 thereof. As best viewed from FIG. 6 and FIG. 7, a pair of profiled passageways 60 extend through the bottom surface 58 of the reflective block 54, and communicate with the concave profiled cavity 56. A pair of assembly sockets 61 extend vertically into opposite ends of the reflective block 54, and are dimensioned to receive the assembly posts 46 of the dielectric housing 26 to locate block 54 with respect to housing 26.

A transparent or translucent, at the option of the user, lens receptacle block 62 is provided as shown in FIG. 1, and comprises a rectangular block configuration having an internal chamber 63, and an upper lens surface 66. A base encasement 68 further comprises a component part of the subject light display assembly, and provides an access opening 70 in one side thereof. An outer encasement body 72, as shown, includes an internal cavity 74, an opening 76 in an upper surface thereof, and a resilient wing projection 75 on opposite sides having stepped flange surfaces 80,82.

Assembly of the subject light display assembly proceeds as follows, with initial reference to FIG. 2. The strip of contact components is positioned above, and then lowered toward the dielectric housing 26, with adjacent sets of contact components 4,6, and 20,22, located directly above the cavities 28,30, respectively. It will be appreciated that the sets of adjacent contact components shown in FIG. 2 are but two of many serially located contact component pairs which are integrally joined to the carrier strip portions 10. Each of the contact components 4,6 and 20,22 is staked into a dielectric housing cavities and severed from the carrier strip 10 at a prenotched location. The profile of each cavity is such so as to permit positionment of a pair of contact components therein. There located, the right-angled shaped body portion 8 of each contact component rests upon the internal support surfaces 38 and 40 of a respective cavity, and the right-angled body portion is positioned to extend about the projection 36 of the cavity. So located, the resilient spring finger 16 of contact components 4,6,20,22 projects vertically upward from the dielectric body, and opposes the resilient spring finger 16 of its corresponding opposing contact component. The contact components 4,6, thus reside jointly in the serpentine-shaped cavity 28, but are electrically isolated from one another when the LED chip is inserted. It will be appreciated that the adjacent contact components 20,22 are likewise inserted into the serpentine-shaped cavity 30, with the distinction made that the biased tip portions 18 of the contact components 20,22 are directed opposite to the contact tip portions 18 of contact components 4,6. The positionment of the contact components within respective cavities is best viewed from FIG. 4. Note that the complementary directed tip portions 18 of each set of contact components are positioned above the upper surface 32 of the dielectric housing 26. Further, the contact tip portions 18 of opposing contact components are spring loaded against one another prior to receipt of a light-emitting semiconductor chip 24 therebetween. The resilient action of the spring finger 16 exerts residual spring forces on the semiconductor chip 24, and thereby effectuates a positive electrical junction between the contact tip portions 18 and the semiconductor chip. The contact tips may be pre-coated with solder, which may then be reflowed to secure the chip 24 between the tip portions.

Figure 4:
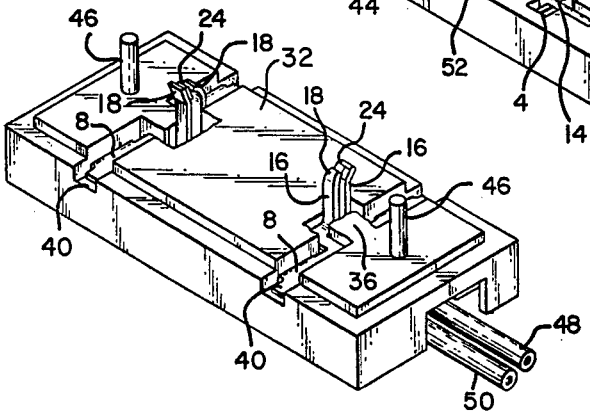
FIG. 4 is a perspective view of the dielectric housing, contact components, and electrical conductors shown from an upright perspective.

Proceeding to FIG. 3, the longitudinal channel 42 is adapted to receive the formed and shaped conductor 50 therein, and protrusions 45 and 43 define a strain relief for the conductor 50 therein, and protrusions 45 and 43 relieve the conductor from tensile stress. A remote end portion of conductor 50 wraps around and projects into the cavity 30, and is laterally inserted into the insulation displacement slot 14 of the contact component 22. The slot pierces through the insulation of the conductor, and effectuates electrical engagement with the conductive core. The opposite end of the conductor 50 projects from the channel 42 at an opposite end of the dielectric housing. The shorter conductor 48 is positioned within the serpentine cavity 28, and is strain relieved by protrusion 45, and is inserted into the insulation displacement slot 14 of contact component 6. The shorter conductor 48 is likewise electrically engaged by insulation displacement operation of the contact component 6, and exits the dielectric housing at the same point that the longer conductor 50 does. The exit direction of conductors 48, 50 through either of portals 41 may be reversed if a particular application requires the light display to be panel mounted where the conductors must exit in only one direction. The current-limiting resistor 52, similarly, is positioned within the longitudinal channel 44 of the dielectric housing, and end conductive portions of the current-limiting resistor project laterally into the insulation displacement slots 14 of contact components 4 and 20. Thus, a series electrical path is established between the contact components 6,4,20, and 22, by the arrangement aforedescribed. A view of the terminated contact components is shown by FIG. 4 from an upright perspective, with the pair of lightemitting semiconductor chips 24 properly positioned in supportive and electrical contacting engagement between corresponding contact spring finger tip portions 18. The semiconductor chips 24 thus are electrically joined in series, and conductors 48, 50 provide the external electrical interface to the light-emitting packages.

Figure 6:
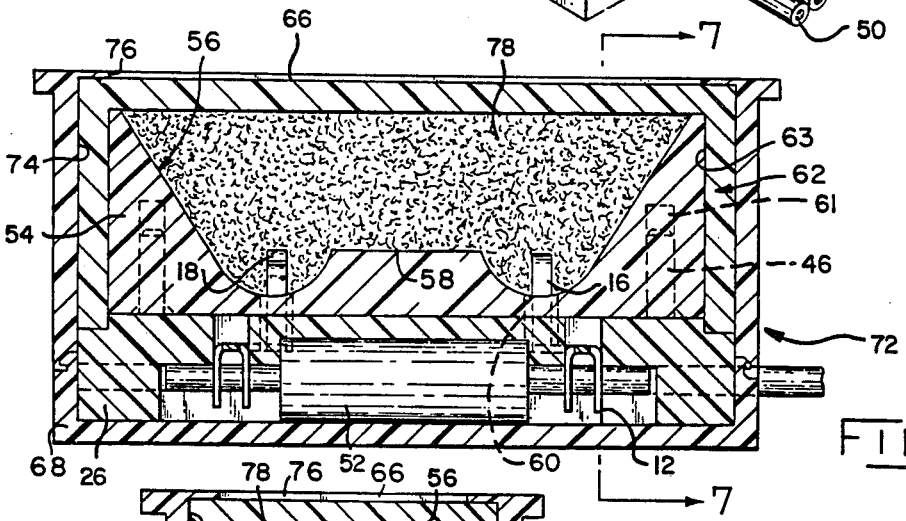
FIG. 6 is a longitudinal section view through the completed assembly illustrated in FIG. 5.
Figure 7:
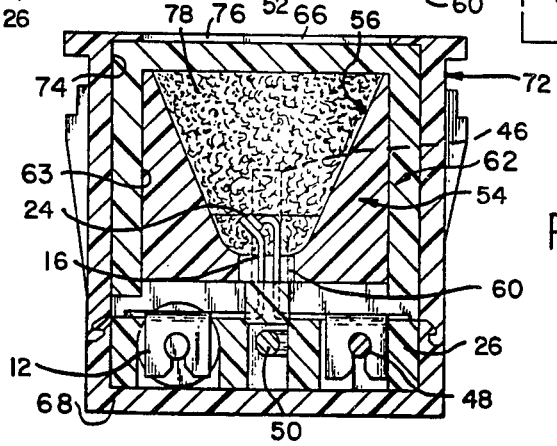
FIG. 7 is a transverse section view taken along line 7—7 of FIG. 6.

Proceeding, with specific reference to FIGS. 1,6 and 7, the lens receptacle block 62 is upended and filled with a measure of adhesive material 78 such as epoxy. The lens receptacle block 62 receives the reflective block 54 therein, which in turn receives the above described dielectric housing subassembly therein. The resilient spring fingers 16 of the contact components project through the profiled passageways 60 of the reflective block 54, and the tip portions 18 and the semiconductor chips 24 therebetween project into the concave cavity 56 of the reflective block 54. Upon the curing of epoxy material 78, the resilient spring fingers 16 and the semiconductor chips 24 are securely fixed in position within the concave cavity 56, and are immune to external disturbance. The assembly posts 46 of the dielectric housing 26 project into the assembly sockets 61 of the reflective block 54, and serve to accurately locate the dielectric housing to the reflective block without mechanically disturbing the semiconductor chips.

In the assembled state, the semiconductor chips 24 face the lens surface 66 of the lens block 62. The reflective concave profile of the reflective block cavity 56 serves to direct the generated light toward the lens surface 66.

Finally, the lens receptacle block 62 is sandwiched between the base encasement 68 and the upper encasement body 72 which are latchably secured together as shown in FIGS. 6 and 7, which provide the structural means for mounting the light display assembly into a panel or the like. The semiconductor chips have substantially longer life cycle than currently used incandescent sources. Also, the power requirements are substantially less.

It should be noted that the transparent (or optionally translucent) lens surface 66 acts to diffuse the light from the semiconductor chips, dispersing the light in order to back-illuminate a greater area. A message may be displayed on surface 66 of the lens block, which will be back-lighted by the operation of the light display. Also, the relatively large mass represented by the contact components provides a heat sink to the semiconductor devices.

Figure 5:
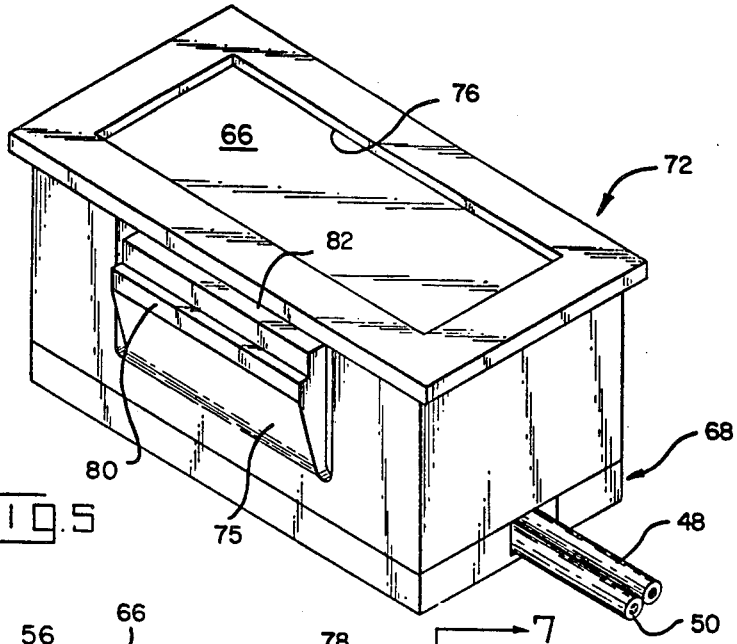
FIG. 5 is a perspective view of the present invention shown in the completed state of assembly.

The package shown in FIG. 5 may be mounted into panel openings of varying size since the wing projections 75 are flexible, and will snap either one of flange surfaces 80,82 into place depending on the thickness of the panel. In addition, as set forth previously, conductors 48 and 50 may optionally exit from either end of the subject assembly if desired.

While the above description describes the preferred embodiment of the subject invention, other embodiments, which will be apparent to those skilled in the art, and which utilize the teachings herein set forth, are intended to be within the scope and spirit of the invention.

I claim:

1. A light display comprising:

a light-emitting semiconductor device;

a pair of conductive contact components each comprising a planar body portion having an upwardly directed resilient finger portion at one end and depending insulation displacement means at an end opposite said one end for establishing electrical connection with an insulated conductor, said upward finger portions having remote ends spaced apart in opposition to one another and profiled for resilient support of said semiconductor therebetween;

a dielectric housing having a profiled cavity therein extending from a top surface to a bottom surface thereof for retentive receipt of said contact components therein, said housing having channels formed within said bottom surface into which said insulation displacement means of said contact components project;

conductor means situated within said channels and in electrical engagement with said insulation displacement means;

receptacle block means of a general box-like configuration having an interior chamber and one side open to receive said dielectric housing in said chamber, with said semiconductor device facing an optically transparent display surface of said receptacle block means.

2. A light display as set forth in claim 1, further comprising reflective means receivable within said receptacle block means chamber for fixturing said dielectric housing and having means for directing light from said light-emitting semiconductor device toward said receptacle block means display surface.

3. A light display as set forth in claim 2, wherein said reflective means comprises a body seated within said chamber has a top surface facing said transparent display surface of said receptacle block means and a bottom surface, and a profiled passage within said bottom surface communicating with said chamber, said passage being dimensioned to closely receive said resilient finger portions of said contact components therethrough.

4. A light display as set forth in claim 3, wherein said reflective means has internal reflective surfaces defining a concave cavity.

5. A light display as set forth in claim 1, wherein said insulation displacement means of said contact component comprises a plate portion integral with one side of said body portion, and adapted to project downward therefrom, said plate portion having a profiled slot extending upwardly therein from a bottom thereof, dimensioned to engageably receive said conductor means therein.

6. A light display as set forth in claim 1, further comprising protective encasement means for encasing said receptacle block means, said encasement means having an opening positioned in alignment with said display surface of said receptacle block means.

7. A light display as set forth in claim 1, wherein said receptacle block means is composed of lensing material means.

8. A light display, comprising:

dielectric housing means having an upper surface and channel means;

electrical terminal means mounted in said housing means, said electrical terminal means resilient finger means and conductor-connecting means, said resilient finger means extending outwardly from said upper surface and electrically connected to semiconductor chip means, said conductor-connecting means disposed in said channel means for electrical connection with electrical conductor means;

reflective block means mounted on said housing means and having opening means and reflective surface means, said resilient finger means with said semiconductor chip means extending through said opening means and being adjacent said reflective surface means so that light emitted from said semiconductor chip means is reflected by said reflective surface means;

lens receptacle block means having lens surface means secured to said reflective block means so that said reflective surface means directs light from said semiconductor chip means onto said lens surface means; and means securing said lens receptacle block means and said housing means together.

9. A light display as set forth in claim 8, wherein other channel means is located in said housing means in which resistor means is electrically connected to the conductor-connecting means disposed in said other channel means.

10. A light display as set forth in claim 8, wherein reflective surface means defines a concave cavity in which light-transmitting securing means is located that secures said reflective block means and said lens receptacle block means together.

11. A light display as set forth in claim 8, wherein said securing means includes encasement means encasing said housing means, said reflective block means and said lens receptacle block means, said encasement means having an opening exposing said lens surface means.

12. A light display as set forth in claim 11, wherein flexible wing projections are located on said encasement means and have flange surfaces for mounting the light display in a panel opening.

13. A light display as set forth in claim 8, wherein alignment means are provided by said housing means and said reflective block means to properly align them when said resilient finger means with said semiconductor chip means extend through said opening means.

* * * * *